US007903032B2

(12) United States Patent
Ying et al.

(10) Patent No.: US 7,903,032 B2
(45) **Date of Patent: *Mar. 8, 2011**

(54) ANTENNA FOR A COMMUNICATION TERMINAL

(75) Inventors: Zhinong Ying, Lund (SE); Johan Andersson, Malmö (SE)

(73) Assignee: Sony Ericsson Mobile Communications AB, Lund (SE)

( * ) Notice: Subject to any disclaimer, the term of this patent is extended or adjusted under 35 U.S.C. 154(b) by 924 days.

This patent is subject to a terminal disclaimer.

(21) Appl. No.: 11/740,310

(22) Filed: Apr. 26, 2007

(65) Prior Publication Data

US 2008/0246690 A1 Oct. 9, 2008

Related U.S. Application Data

(60) Provisional application No. 60/910,252, filed on Apr. 5, 2007.

(51) Int. Cl.
*H01Q 1/24* (2006.01)

(52) U.S. Cl. ..... 343/702; 343/846

(58) Field of Classification Search ..... 343/700 MS, 343/702, 895, 846

See application file for complete search history.

(56) References Cited

U.S. PATENT DOCUMENTS

| | | | | |
|---|---|---|---|---|
| 6,750,821 | B2 * | 6/2004 | Fang et al. | 343/700 MS |
| 7,639,188 | B2 * | 12/2009 | Ying et al. | 343/702 |
| 7,649,501 | B2 * | 1/2010 | Wong et al. | 343/702 |
| 2003/0058176 | A1 | 3/2003 | Keilen et al. | |
| 2003/0214444 | A1 | 11/2003 | Asai et al. | |
| 2004/0125030 | A1 | 7/2004 | Sung et al. | |
| 2006/0214856 | A1 | 9/2006 | Nakano | |

FOREIGN PATENT DOCUMENTS

DE 103 47 722 7/2004

OTHER PUBLICATIONS

International Search Report for corresponding Application No. PCT/EP2007/060431 mailed Jan. 21, 2008.

* cited by examiner

*Primary Examiner* — Tan Ho

(74) *Attorney, Agent, or Firm* — Renner, Otto, Boisselle & Sklar, LLP

(57) ABSTRACT

A radio antenna device for a radio communication terminal, e.g. a mobile telephone, comprising a flat ground plane and an antenna element having a radio signal feeding point disposed at the ground plane. The antenna element has a folded three dimensional box-like shape. The inventive antenna design provides for an antenna device with compact size, which at the same time is operable in UWB (Ultra Wideband) frequency regions. The antenna device may therefore advantageously be incorporated into a portable communication terminal such as a mobile telephone.

18 Claims, 6 Drawing Sheets

ANTENNA FOR A COMMUNICATION TERMINAL

CROSS REFERENCE TO RELATED APPLICATION

This application claims priority under 35 U.S.C. §119 to U.S. Provisional Application No. 60/910,252, filed Apr. 5, 2007, the entire disclosure of which is incorporated herein by reference.

TECHNICAL FIELD

The present invention relates generally to antennas for radio communication terminals. More particularly, this invention relates to antennas which are operable in Ultra-Wideband (UWB) frequency regions and which are at the same time suitable for incorporation into small-sized portable communication terminals, e.g. mobile telephones.

BACKGROUND

Since the end of the $20^{th}$ century the cellular telephone industry has had enormous development in the world. From the initial analog systems, such as those defined by the standards AMPS (Advanced Mobile Phone System) and NMT (Nordic Mobile Telephone), the development has during recent years been almost exclusively focused on standards for digital solutions for cellular radio network systems, such as D-AMPS (e.g., as specified in EIA/TIA-IS-54-B and IS-136) and GSM (Global System for Mobile Communications). Different digital transmission schemes are used in different systems, e.g. Time Division Multiple Access (TDMA) or Code Division Multiple Access (CDMA). Currently, the cellular technology is entering the so called $3^{rd}$ generation, providing several advantages over the former, $2^{nd}$ generation, digital systems referred to above. Among those advantages an increased bandwidth will be provided, allowing effective communication of more complex data. The $3^{rd}$ generation of mobile systems is referred to as the UMTS (Universal Mobile Telecommunications System) in Europe and CDMA2000 in the USA. Moreover, it is believed that the first generation of Personal Communication Networks (PCNs), employing low cost, pocket-sized, cordless telephones that can be carried comfortably and used to make or receive calls in the home, office, street, car, etc., will be provided by, for example, cellular carriers using the next generation digital cellular system infrastructure.

One evolution in cellular communication services involves the adoption of additional frequency bands for use in handling mobile communications, e.g., for Personal Communication Services (PCS) services. Taking the U.S. as an example, the Cellular hyperband is assigned two frequency bands (commonly referred to as the A frequency band and the B frequency band) for carrying and controlling communications in the 800 MHz region. The PCS hyperband, on the other hand, is specified in the United States to include six different frequency bands (A, B, C, D, E and F) in the 1900 MHz region. Thus, eight frequency bands are now available in any given service area of the U.S. to facilitate communication services. Certain standards have been approved for the PCS hyperband (e.g., PCS1900 (J-STD-007)), while others have been approved for the Cellular hyperband (e.g., D-AMPS (IS-136)). Other frequency bands in which these devices will be operating include GPS (operating in the 1.5 GHz range) and UMTS (operating in the 2.0 GHz range). Each one of the frequency bands specified for the Cellular and PCS hyperbands is allocated a plurality of traffic channels and at least one access or control channel. The control channel is used to control or supervise the operation of mobile stations by means of information transmitted to and received from the mobile stations. Such information may include incoming call signals, outgoing call signals, page signals, page response signals, location registration signals, voice channel assignments, maintenance instructions, hand-off, and cell selection or reselection instructions as a mobile station travels out of the radio coverage of one cell and into the radio coverage of another cell. The control and voice channels may operate using either analog modulation or digital modulation.

The signals transmitted by a base station in the downlink over the traffic and control channels are received by mobile or portable terminals, each of which has at least one antenna. Historically, portable terminals have employed a number of different types of antennas to receive and transmit signals over the air interface. For example, monopole antennas mounted perpendicularly to a conducting surface have been found to provide good radiation characteristics, desirable drive point impedances and relatively simple construction. Monopole antennas can be created in various physical forms. For example, rod or whip antennas have frequently been used in conjunction with portable terminals. For high frequency applications where an antenna's length is to be minimized, another choice is the helical antenna. In addition, mobile terminal manufacturers encounter a constant demand for smaller and smaller terminals. This demand for miniaturization is combined with desire for additional functionality such as having the ability to use the terminal at different frequency bands and different cellular systems.

In the known prior art, it has been commercially desirable to offer portable communication terminals which are capable of operating in widely different frequency bands, e.g., frequency bands located in the 800 MHz, 900 MHz, 1500 MHz, 1800 MHz, 1900 MHz, 2.0 GHz and 2.45 GHz regions. However, in a near future it is expected that it will be increasingly desirable to offer portable terminals which are also capable of operating in frequency bands located within the range from 3.1 GHz up to and including 10.6 GHz, commonly referred to as the Ultra-Wideband (UWB).

Today, the concept of built-in antennas is well known and commonly used by mobile telephone manufacturers, e.g. SONY ERICSSON® and NOKIA®. However, the performance is still a problem when even wider band capabilities are desirable, e.g. when UWB frequency bands are to be covered. Consequently, in the future prior art antenna designs will still be a limiting factor when developing small-sized portable communication terminals with adequate bandwidth.

In view of the above, there appears to be a need for providing an antenna device that mitigates, alleviates or eliminates one or more of the above-mentioned deficiencies or disadvantages in the known prior art. More specifically, there appears to be a need for providing an antenna device having a structure suitable for built-in antennas, which at the same time is operable in Ultra-Wideband (UWB) frequency regions, e.g. from about 3.1 GHz up to and including 10.6 GHz.

SUMMARY OF THE INVENTION

An aspect of the invention relates to a radio antenna device for a radio communication terminal, the antenna device comprising a flat ground plane, and an antenna element having a radio signal feeding point disposed at the ground plane, wherein the antenna element is a monopole antenna element having a folded three dimensional box-like shape.

In one embodiment, the antenna element comprises a plurality of side surfaces and at least one of said side surfaces is located in the same plane as said ground plane in a direction of extension of said ground plane.

In one embodiment, the antenna element comprises first, second, third, and fourth side surfaces, respectively, wherein the first side surface abuts perpendicularly against the second side surface, the second side surface abuts perpendicularly against the third side surface, the third side surface abuts perpendicularly against the fourth side surface, and there is a gap between the first and fourth side, wherein the first, second, third and fourth side surfaces together enclose a hollow interior, the hollow interior having two open ends which are located opposite to each other, and wherein the first, second, third, and fourth side surfaces, the hollow interior, and the two open ends of the hollow interior are arranged in relation to each other such that a non-closed box-like shape is formed by the first, second, third, and fourth side surfaces, the hollow interior, and the two open ends of the hollow interior.

In one embodiment, the first side surface further comprises a protruding member at an upper edge of the first side surface, the protruding member protruding substantially perpendicularly out from said first side surface in a direction such that the protruding member covers at least a portion of an upper open end of said two open ends.

In one embodiment, the fourth side surface further comprises a protruding member at an outermost side edge of the fourth side surface, wherein said outermost side edge does not abut against any other side surface, and wherein the protruding member protrudes substantially perpendicularly out from an upper edge of said fourth side surface.

In one embodiment, the antenna device further comprises fifth and sixth surfaces, wherein a lower portion of the third side surface abuts perpendicularly against the fifth surface, and the fifth surface abuts perpendicularly against the sixth surface, the sixth surface further being attached to a feeding portion connected to the radio signal feeding point.

In one embodiment, the ground plane further comprises a support member attached to said ground plane at a side edge of said ground plane and further protruding substantially perpendicularly out from said ground plane, wherein the second radio signal feeding point is disposed at a center portion of said support member.

In one embodiment, the antenna element is operable in a frequency band being a frequency band located in the 1800 MHz, 1900 MHz, 2.0 GHz, 2.45 GHz, 3.1 GHz, 5.0 GHz, 5.8 GHz or 10.6 GHZ region.

In one embodiment, the antenna element is operable in a frequency band being a frequency band located within the range of 3.1-10.6 GHz.

The different features of the above-mentioned antenna device can be combined in any combination.

Another aspect of the invention relates to a communication terminal comprising the above-mentioned antenna device. The communication terminal may be a device from the group comprising: a portable radio communication equipment, a mobile radio terminal, a mobile telephone, a cellular telephone, a pager, a communicator, an electronic organizer, a smart phone and a computer.

Another aspect of the invention relates to radio antenna device for a radio communication terminal, the antenna device comprising a flat ground plane, and an antenna element having a radio signal feeding point disposed at the ground plane, wherein the antenna element has a shape as illustrated in any of the FIG. 1, 2, 3 or 4 of the accompanying drawings.

In one embodiment, the antenna element is operable in a frequency band being a frequency band located in the 1800 MHz, 1900 MHz, 2.0 GHz, 2.45 GHz, 3.1 GHz, 5.0 GHz, 5.8 GHz or 10.6 GHZ region.

In one embodiment, the antenna element is operable in a frequency band being a frequency band located within the range of 3.1-10.6 GHz.

Another aspect of the invention relates to a communication terminal comprising the above-mentioned antenna device. The communication terminal may be a device from the group comprising: a portable radio communication equipment, a mobile radio terminal, a mobile telephone, a cellular telephone, a pager, a communicator, an electronic organizer, a smart phone and a computer.

Some embodiments of the present invention provide for an antenna device with a compact size, which at the same time is operable in UWB (Ultra Wideband) frequency regions. This makes the antenna device particularly suitable and attractive for implementation in future radio communication terminals, e.g. mobile telephones, which are to be used in current and future mobile communication technologies such as GSM 800, GSM 850, GSM 900, GSM 1800, GSM 1900, 4 GSM, 9 UMTS, 2 WLAN, Bluetooth®, etc.

BRIEF DESCRIPTION OF THE DRAWINGS

Further objects, features and advantages of the invention will appear from the following detailed description of embodiments of the invention, wherein embodiments of the invention will be described in more detail with reference to the accompanying drawings, in which.

DETAILED DESCRIPTION OF EMBODIMENTS

Figure 1:
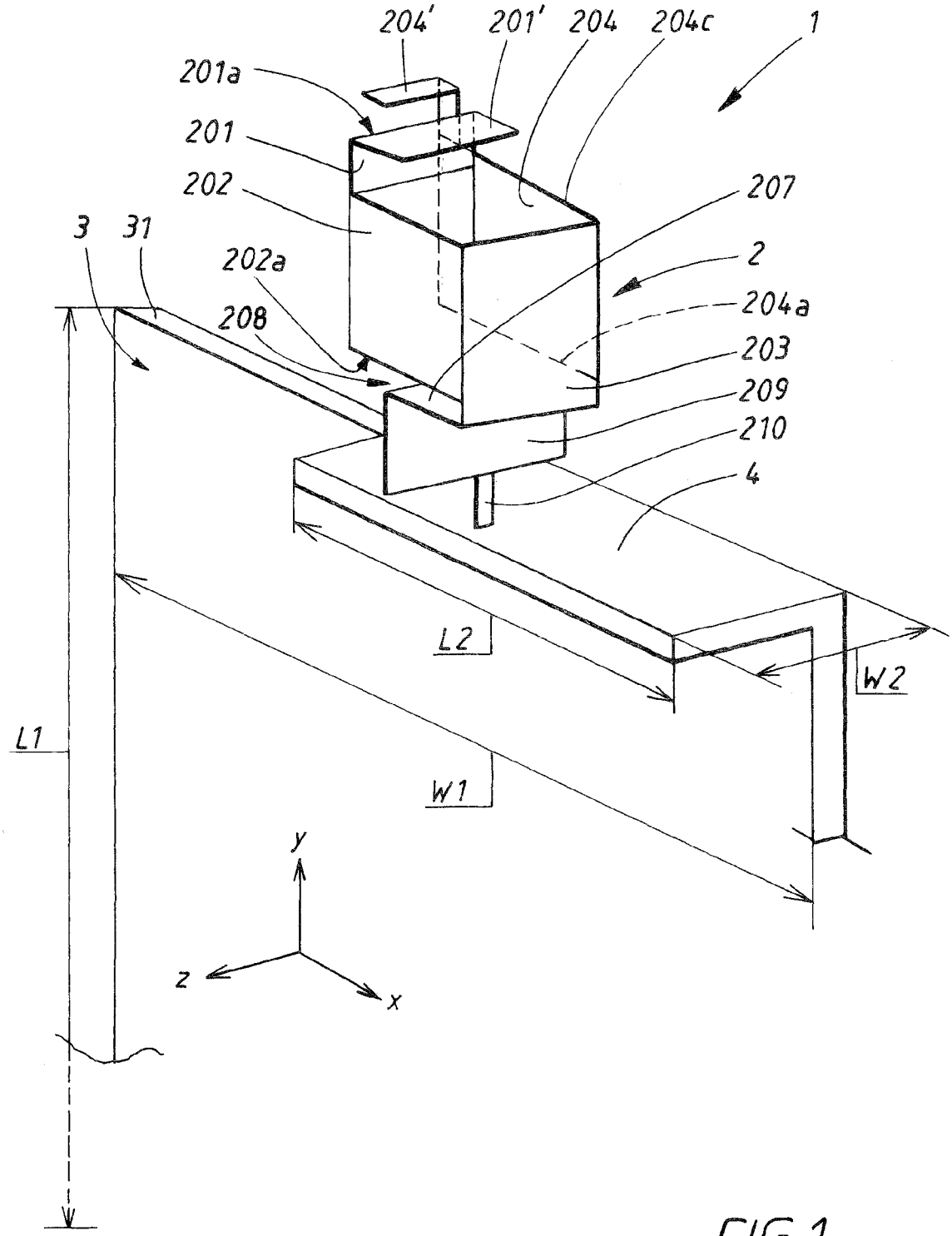
FIG. 1 is a three-dimensional (3D) view of an upper portion of a radio antenna device according to an embodiment of the invention.
Figure 2:
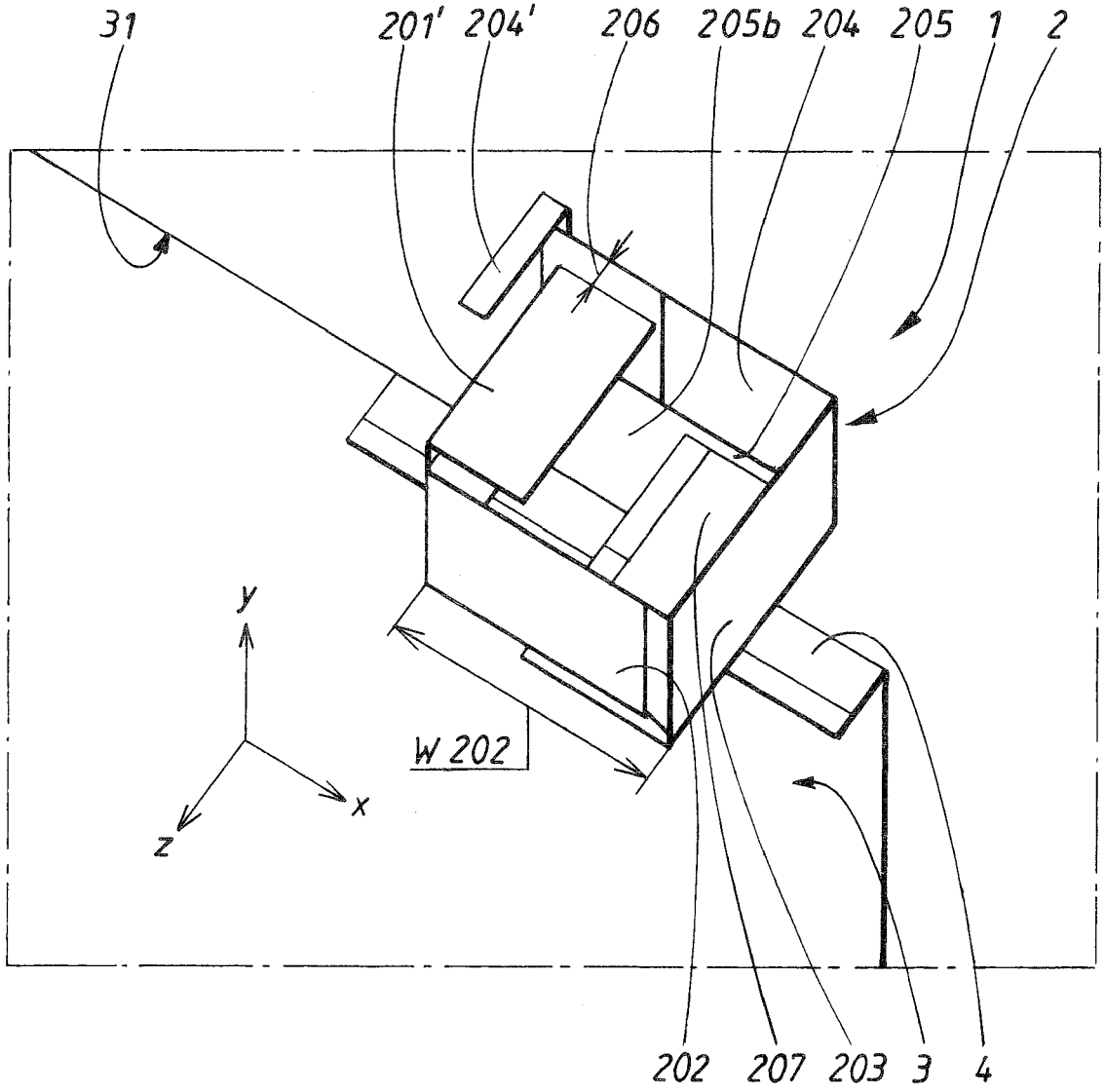
FIGS. 2-4 are 3D views from different angles of the upper portion of the antenna device of FIG. 1.
Figure 3:
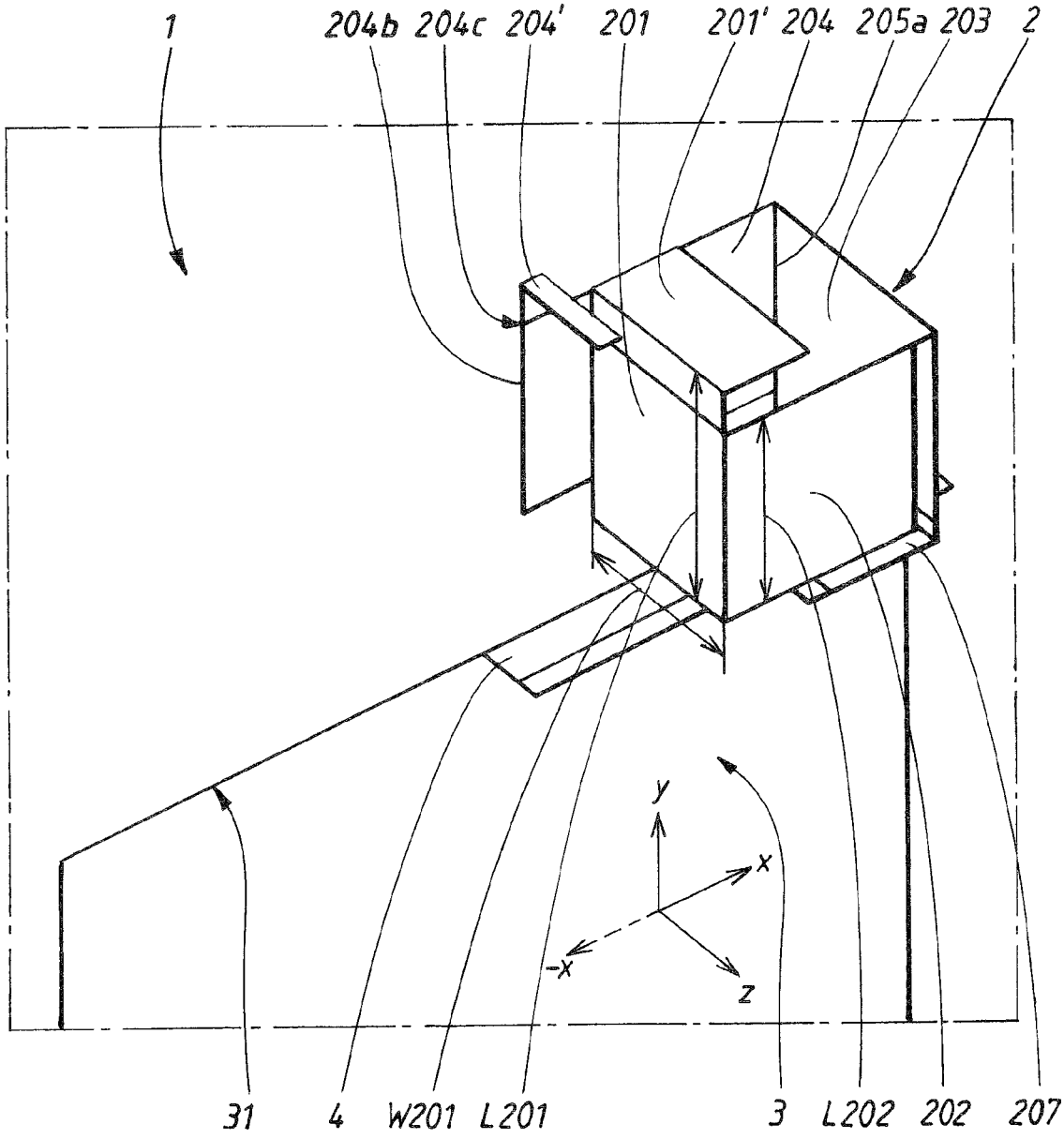
Figure 4:
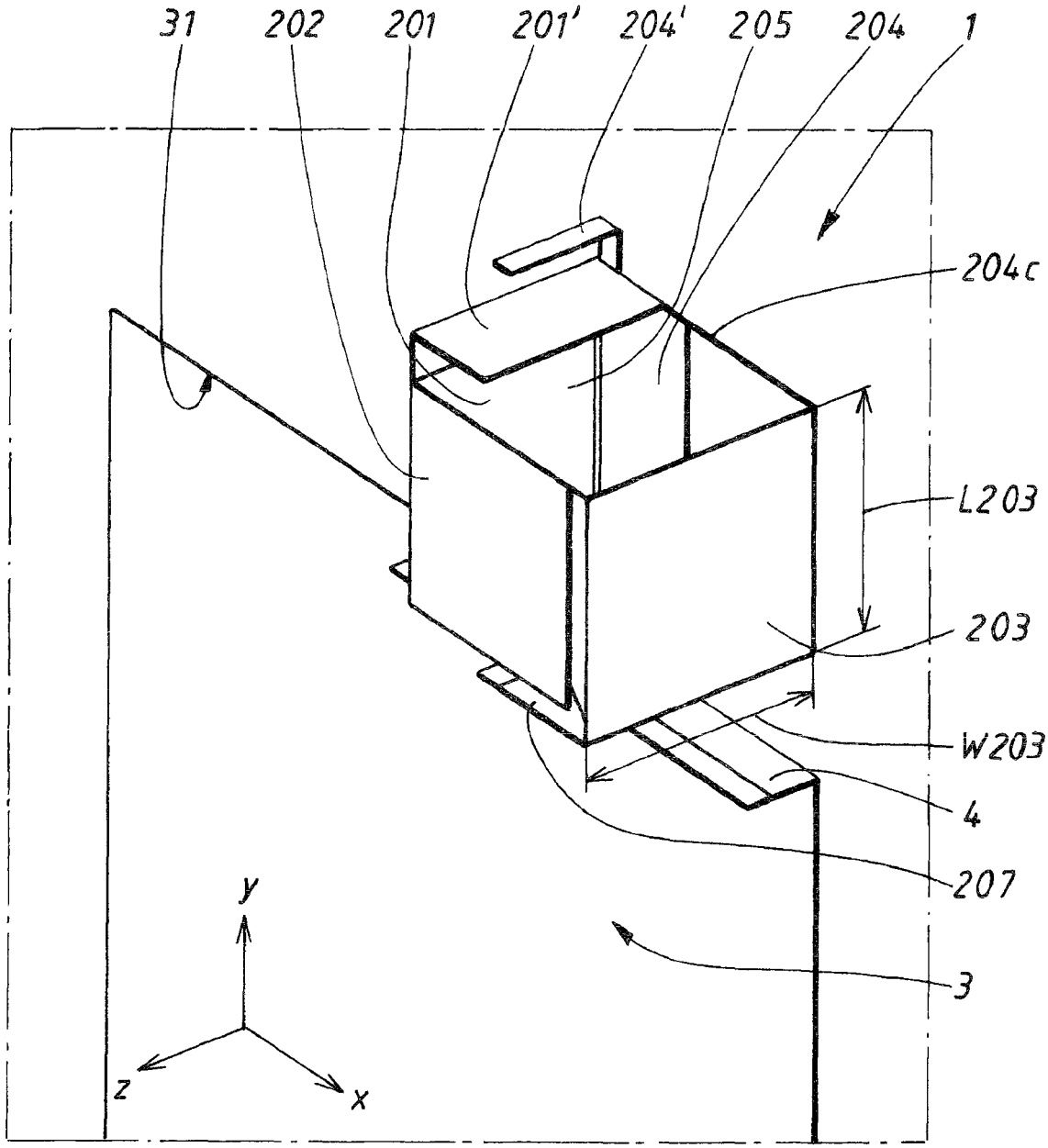

An embodiment of the present invention will be described more fully hereinafter with reference to the accompanying drawings. The embodiment of the invention is provided so that this disclosure will be thorough and complete, and will fully convey the scope of the invention to those skilled in the art. Like numbers refer to like elements throughout the drawings. The present description refers to radio terminals as devices in which to implement a radio antenna design according to embodiments of the present invention. The term radio terminal includes all mobile equipment devised for radio communication with a radio station, which radio station also may be mobile terminal or e.g. a stationary base station. Consequently, the term radio terminal includes mobile telephones, pagers, communicators, electronic organizers, smart phones, Personal Digital Assistants (PDA:s), vehicle-mounted radio communication devices, or the like, as well as portable laptop computers devised for wireless communication in e.g. a WLAN (Wireless Local Area Network). Furthermore, since the antenna device as such is suitable for but not restricted to mobile use, the term radio terminal should also be understood as to include any stationary device arranged for radio communication, such as e.g. desktop computers, printers, fax machines and so on, devised to operate with radio communication with each other or some other radio station. Hence, although the structure and characteristics of the antenna design according to embodiments of the invention is mainly described herein, by way of example, in the implementation in a mobile phone, this is not to be interpreted as excluding the implementation of the inventive antenna design in other types of radio terminals, for instance such as those listed above.

Some embodiments of the present invention provide an antenna design which is operable in UWB frequency bands, i.e. within the range from about 3.1 GHz up to and including 10.6 GHz. At the same time, the compact antenna design is such that it is suitable as a built-in antenna in a portable communication terminal, e.g. a mobile telephone. As used herein the term built-in antenna is used to mean that the antenna is placed inside, or adjacent to, the housing or chassis of the radio communication terminal. The compact size and the simultaneous capability of being operable at UWB frequencies makes this antenna design particularly suitable and attractive for implementation in future radio communication terminals, which are to be used in current and future mobile communication technologies such as GSM 800, GSM 850, GSM 900, GSM 1800, GSM 1900, 4 GSM, 9 UMTS, 2 WLAN, Bluetooth®, etc.

An antenna concept or design will be described herein, comprising the antenna structure, its relation to ground, and its implementation in a radio terminal, with reference to the accompanying drawings. Some features of one embodiment of the inventive antenna design are one antenna element having the shape as illustrated in any of the FIG. 1, 2, 3 or 4. Thanks to the shape of the antenna element, as illustrated in the figures, it has turned out in computer simulations that it is indeed possible to provide an antenna device with a relatively small size, which at the same time shows surprisingly good characteristics in UWB frequency bands considering the relatively small dimensions of the antenna element. The computer simulations have been performed using the simulation tool CST Microwave Studio®® 2006B from COMPUTER SIMULATION TECHNOLOGY.

The inventive antenna design according to an embodiment of the invention will hereinafter be described in connection with FIGS. 1 through 4, wherein the antenna design is illustrated from different view angles. FIGS. 1-4 disclose an antenna device 1 comprising an antenna element 2, e.g. a monopole antenna element, and a ground plane or substrate 3. In FIGS. 1-4, a three-dimensional system of co-ordinates is defined. Accordingly, an x axis, a y axis and a z axis are defined for the antenna device 1. As can be seen in the figures, the y axis represents the longitudinal direction of the antenna device 1. Furthermore, the x axis represents the latitudinal direction of the antenna device 1.

In the preferred and disclosed embodiment, the length L1 of the ground plane 3, i.e. the height of the ground plane 3, is approximately 100 mm. Furthermore, the width W1 in FIG. 1 is approximately 40 mm. However, it should be appreciated that the length L1 and the width W1 can be varied in dependence of the purpose of the antenna design and must hence be tested and evaluated in each specific case.

As can be seen in the figures, the antenna element 2 has a folded shape. The antenna element comprises a plurality of side surfaces 201, 202, 203 and 204. As can be seen in FIGS. 1-4, one of the side surfaces (i.e. the side surface denoted 204) of the antenna element 2 is located in substantially the same plane as said ground plane 3 and in the direction y of extension of the ground plane 3. Furthermore, the ground plane 3 may further comprise a protruding support member 4. The support member 4 may be a rectangular support member. For example, the width W2 of the support member 4 may be about 5 mm and the length L2 of the support member 4 may be about 20 mm. It should, however, be appreciated that the exact dimensions of the support member 4 can be varied in dependence of the purpose of the antenna design and must hence be tested and evaluated in each specific case. The support member 4 may be attached to an upper side edge 31 of the ground plane 3. Furthermore, the support member 4 may protrude substantially perpendicularly out from the ground plane 3. In the preferred and disclosed embodiment of the antenna device 1, the antenna element 2 is fed at a radio signal feeding point 5, which is disposed at a center portion of the support member 4 as shown in FIG. 1.

The antenna element 2 comprises a first side surface 201, a second side surface 202, a third side surface 203 and a fourth side surface 204, which are folded in relation to each other such that these side surfaces 201, 202, 203, and 204 together form a three-dimensional box-like shape. In the preferred and disclosed embodiment, the first side surface 201 abuts perpendicularly against the second side surface 202. Likewise, the second side surface 202 abuts perpendicularly against the third side surface 203. In the same way, the third side surface 203 abuts perpendicularly against the fourth side surface 204. It may be advantageous that the above-mentioned side surfaces abut perpendicularly against each other, i.e. with an angle of about 90° between each other. However, it should of course be appreciated that it is not necessary that the above-mentioned surfaces abut exactly perpendicularly against each other. Other angles may be equally possible, e.g. angles in the range of about 60-90°. As can be seen in figures, particularly in FIG. 2, the three-dimensional box-like shape also comprises a hollow interior 205 with two opposite open ends, i.e. an upper open end 205*a* and a lower open end 205*b*. The lower open end 205*b* is located opposite said upper open end 205*a*. Moreover, as is illustrated in the figures, particularly in FIG. 2, there is a relatively narrow opening or gap 206 between the first side surface 201 and the fourth side surface 204. Consequently, a non-closed box-like shape is formed by the four side surfaces 201, 202, 203, 204, the hollow interior 205, the upper and lower open ends 205*a*, 205*b*, and the gap 206. The distance of the gap 206 may e.g. be 2 mm. However, the exact distance of the gap 206 is in fact not critical for the function of the antenna element 2. It should be appreciated that this distance can be varied in dependence of the purpose of the antenna design and must hence be tested and evaluated in each specific case.

A lower portion 203*a* of the third side 203 abuts perpendicularly against a fifth surface 207, which is located at a distance away from lower portions 202*a* and 204*a* of the second and fourth side surfaces 202, 204, respectively. Thus, there is formed a relatively narrow opening or gap 208 between the fifth surface 207 and the lower portions 202*a* and 204*a*. It should be noted that the exact distance of the narrow gap 208 is not critical for the function of the antenna element 2. Therefore, it should be appreciated that this distance can be varied in dependence of the purpose of the antenna design and must hence be tested and evaluated in each specific case. In the disclosed and preferred embodiment, the fifth surface 207 further abuts perpendicularly to a sixth surface 209, which in turn is attached to a feeding portion 210. The feeding portion 210 is connected to the radio signal feeding point 5 disposed at the support member 4 of the ground plane 3.

As can be seen in the figures, the first side surface 201 may further comprise a protruding member 201' at an upper edge 201*a* of the first side surface 201. As is clearly and unambiguously disclosed in the drawings, the protruding member 201' protrudes substantially perpendicularly out from said first side surface 201' in the x-direction. This way, the protruding member 201' extends in the x-direction such that the protruding member 201' covers at least a portion of the upper open end 205*a* of the non-closed box-like shaped antenna element 2.

As can further be seen in the figures, the fourth side surface 204 has a width $W_{204}$ which is larger that the width $W_{202}$ of the opposite second side surface 202. As can be clearly and unambiguously seen in the figures, particularly FIG. 3, the fourth side surface 204 extends in the –x-direction beyond the first side surface 201. At an outermost side edge 204*b*, which outermost side edge 204*b* does not abut against any other side surface, there is provided a protruding member 204'. As is disclosed in the figures, this protruding member 204' protrudes substantially perpendicularly out from an upper edge 204*c* of said fourth side surface 204' and in the z-direction.

In the disclosed exemplary embodiment, the first side surface 201 has a width $W_{20}$, of approximately 8 mm and a length $L_{201}$ of approximately 18 mm. Furthermore, the second side surface 202 has a width $W_{202}$ of approximately 10 mm and a length $L_{202}$ of approximately 14 mm. The fourth side surface 204 has a width $W_{204}$ of approximately 13 mm and a length $L_{204}$ of approximately 14 mm. The third side 203 has a width $W_{203}$ of approximately 10 mm. Furthermore, the third side surface 203 has a length $L_{203}$ which is longer than the lengths $L_{202}$ and $L_{204}$, respectively. For example, the length $L_{203}$ may be about 16 mm. The above-mentioned dimensions are illustrative examples of suitable dimensions. However, it should be appreciated that the exact dimensions of the antenna element 2 could be varied in dependence of the purpose of the antenna design. In fact, the dimensions may indeed be up to the artistic freedom of the person skilled in the art and should therefore be tested and evaluated in each specific case.

In the preferred and disclosed embodiment of the antenna device 1, the antenna element 2 has a folded three-dimensional non-closed box-like shape as illustrated in the FIGS. 1-4. It has turned out that this peculiar shape yields a large effective antenna volume which contributes to surprisingly good VSWR characteristics in UWB frequency band regions, as will be further described with respect to FIG. 6. At the same time, as is evidenced by this description taken in conjunction with the drawings, the dimensions of this three-dimensional box-like antenna element is such that it is attractive for incorporation in small-sized devices, e.g. portable communication terminals. The antenna device 1 may thus configured to be tuned for an ultra wide frequency band. e.g. a frequency band region located in the 1800 MHz, 1900 MHz, 2.0 GHz, 2.45 GHz, 3.1 GHz, 5.0 GHz, 5.8 GHz or 10.6 GHZ region. In one embodiment, when implemented in a communication terminal, e.g. mobile phone 50 (see FIG. 5), the antenna element 2 is configured to function together with the chassis of the communication terminal to match the antenna element 2 from e.g. 1.7 GHz up to and including 10.6 GHz frequency band regions. Consequently, the antenna element 2 may e.g. be configured for GSM 1800, GSM 1900, UMTS or above.

Figure 5:
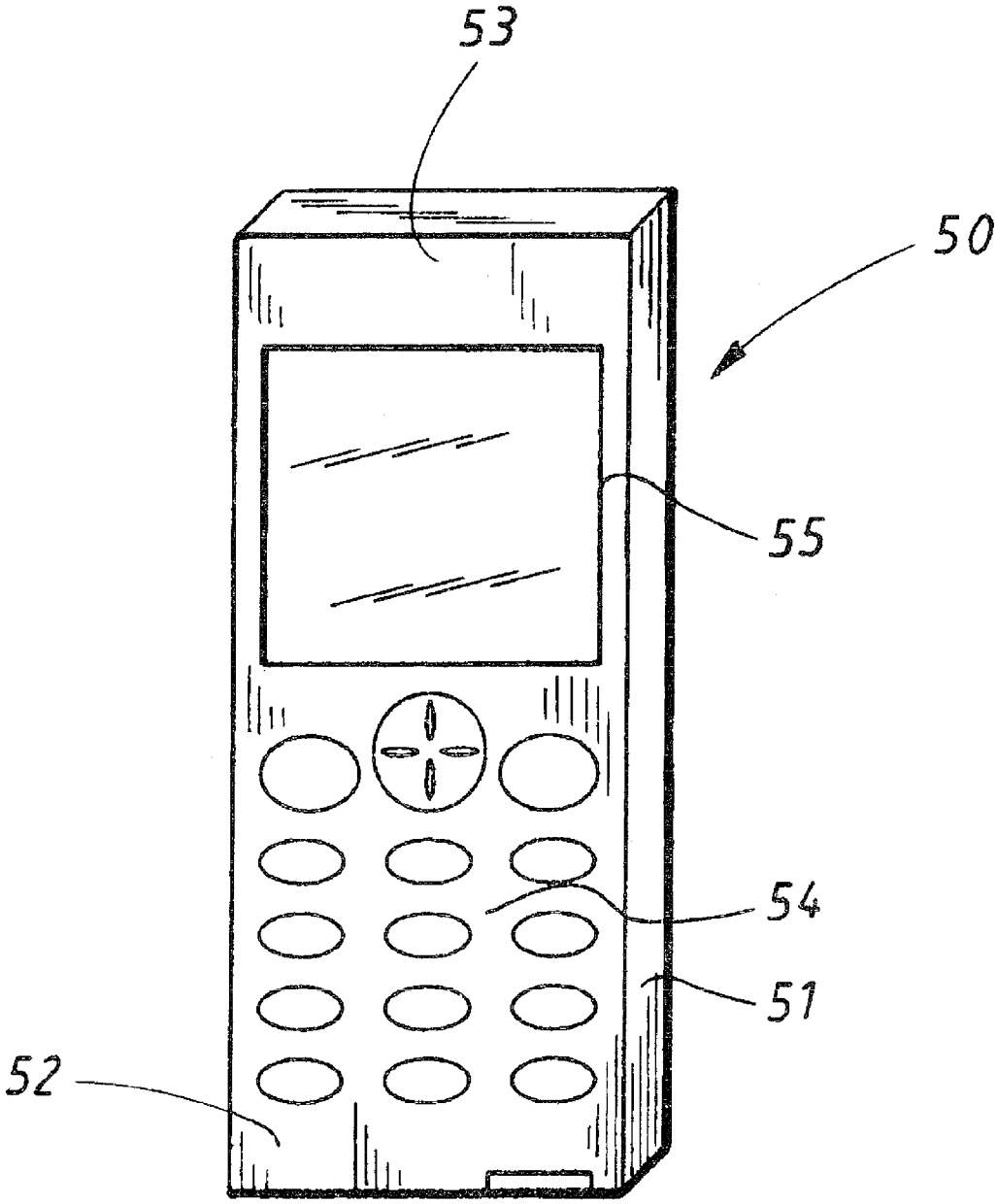
FIG. 5 is an exemplary communication terminal incorporating the antenna device illustrated in FIGS. 1-4.

FIG. 5 illustrates a communication radio terminal in the embodiment of a cellular mobile phone 50 devised for radio communication. It should be understood that the outer appearance of the mobile phone 50 need not take the indicated shape of FIG. 5. Instead the mobile phone 50 may e.g. be of a clamshell type, a jack knife type, or the like. The terminal 50 comprises a chassis or housing 51, carrying a user audio input in the form of a microphone 52 and a user audio output in the form of a loudspeaker 53 or a connector to an ear piece (not shown). A set of keys, buttons or the like constitutes a data input interface 54 usable e.g. for dialing, according to the established art. A data output interface comprising a display 55 is further included, devised to display communication information, address list etc in a manner well known to the skilled person. The radio communication terminal 50 also includes radio transmission and reception electronics (not shown), and is further devised with a built-in antenna device 1 inside the housing 51. According to an embodiment of the present invention, this antenna device 1, corresponding to FIGS. 1-4, includes an antenna element 2 and a ground plane or substrate 3. The antenna element 2 has a radio signal feeding point 5 disposed at the ground plane 3. Furthermore, the antenna element 2 has the shape as illustrated in any of the FIGS. 1-4. The other features of the antenna design according to the present invention described hereinabove with reference to FIGS. 1-4 are therefore naturally equally valid for the radio terminal implemented embodiment of FIG. 4.

Figure 6:
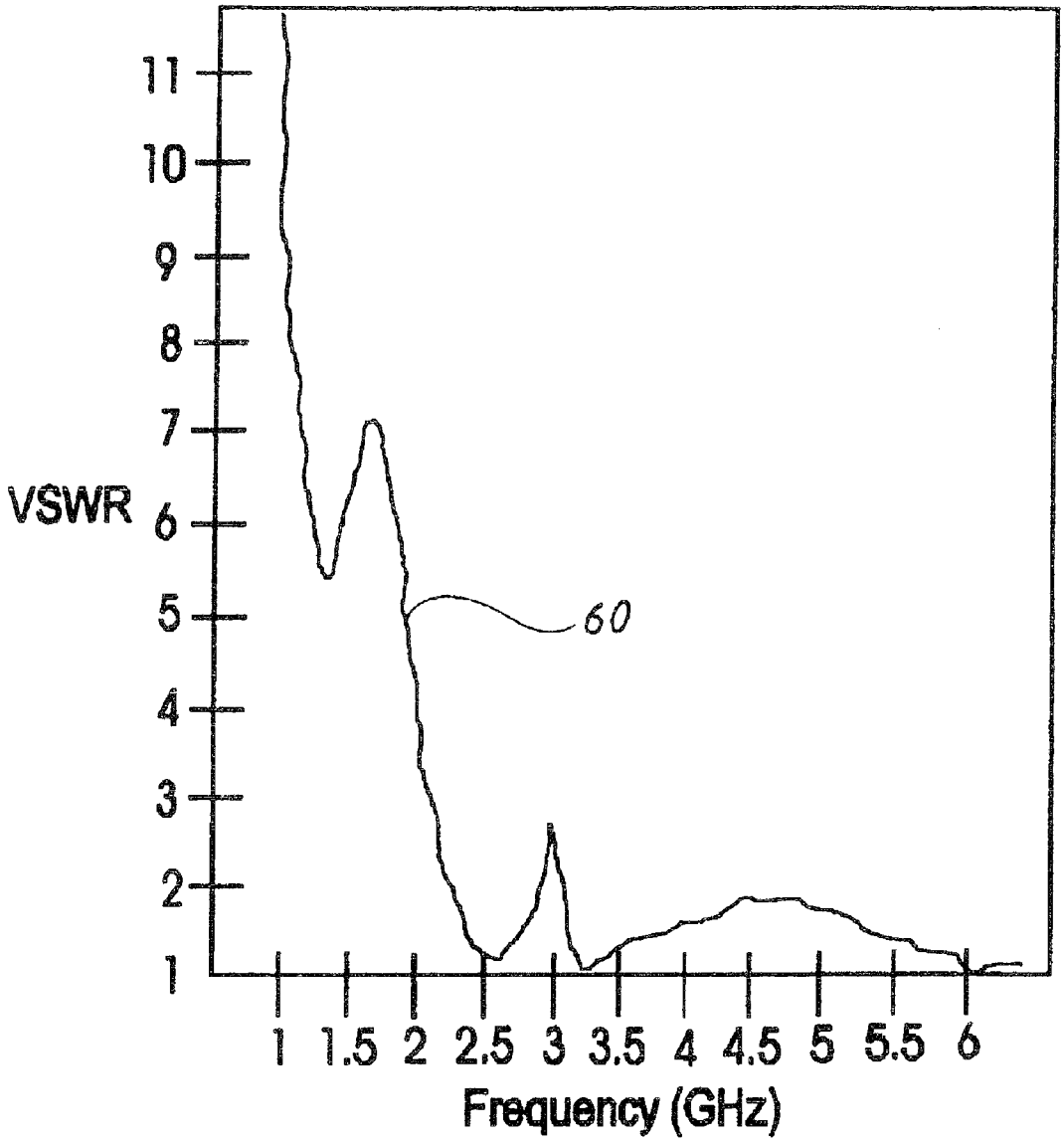
FIG. 6 illustrates the Voltage Standing Wave Ratio (VSWR) characteristics for the antenna design of an embodiment of the present invention.

FIG. 6 illustrates the VSWR performance of the presented antenna design, in an embodiment as described in conjunction with FIGS. 1-4, i.e. with the dimensions in the preferred and disclosed embodiment. As can be seen from FIG. 6, the VSWR 60 is below 5.0 for frequencies from approximately 1.8 GHz and above. Consequently, the performance of the antenna device is considered to have sufficiently good performance frequencies from about 1.8 GHz and above and, hence, in UWB frequency band regions. Furthermore, as is evidenced by the dimensions of the disclosed embodiment, the inventive antenna design is suitable for antennas to be internally built into communication terminals with compact size.

The terminology used in this specification is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

The foregoing has described the principles, preferred embodiments and modes of operation of the present invention. However, the invention should not be construed as being limited to the particular embodiments discussed above. For example, while the antenna of the present invention has been discussed primarily as being suitable for antennas to be incorporated into small-sized devices, e.g. portable communication terminals, the antenna design could equally possible be implemented as an external antenna device or the like e.g. mounted onto the chassis of a portable communication terminal. Furthermore, while the antenna of the present invention has been discussed primarily as being a radiator, one skilled in the art will appreciate that the antenna of the present invention would also be used as a sensor for receiving information at specific frequencies. Similarly, the dimensions of the various elements may vary based on the specific application. Thus, the above-described embodiments should be regarded as illustrative rather than restrictive, and it should be appreciated that variations may be made in those embodiments by persons skilled in the art without departing from the scope of the present invention as defined by the appended claims.

We claim:

1. A radio antenna device for a radio communication terminal, the antenna device comprising:

a flat ground plane; and an antenna element having a radio signal feeding point disposed at the ground plane, wherein the antenna element is a monopole antenna element having a folded three dimensional box-like shape, and wherein the antenna element comprises a plurality of side surfaces and at least one of said side surfaces is located in the same plane as said ground plane in a direction of extension of said ground plane.

2. The antenna device according to claim 1, wherein the antenna element comprises:

first, second, third, and fourth side surfaces, respectively, wherein the first side surface abuts perpendicularly against the second side surface, the second side surface abuts perpendicularly against the third side surface, the third side surface abuts perpendicularly against the fourth side surface, and there is a gap between the first and fourth side, wherein the first, second, third and fourth side surfaces together enclose a hollow interior, the hollow interior having two open ends which are located opposite to each other, and wherein the first, second, third, and fourth side surfaces, the hollow interior, and the two open ends of the hollow interior are arranged in relation to each other such that a non-closed box-like shape is formed by the first, second, third, and fourth side surfaces, the hollow interior, and the two open ends of the hollow interior.

3. A communication terminal comprising an antenna device according to claim 1.

4. The communication terminal according to claim 3, wherein the communication terminal is a device from the group comprising: a portable radio communication equipment, a mobile radio terminal, a mobile telephone, a cellular telephone, a pager, a communicator, an electronic organizer, a smart phone and a computer.

5. A radio antenna device for a radio communication terminal, the antenna device comprising:

a flat ground plane; and an antenna element having a radio signal feeding point disposed at the ground plane, wherein the antenna element is a monopole antenna element having a folded three dimensional box-like shape, wherein the antenna element comprises a plurality of side surfaces and at least one of said side surfaces is located in the same plane as said ground plane in a direction of extension of said ground plane, wherein the antenna element comprises:

first, second, third, and fourth side surfaces, respectively, wherein the first side surface abuts perpendicularly against the second side surface, the second side surface abuts perpendicularly against the third side surface, the third side surface abuts perpendicularly against the fourth side surface, and there is a gap between the first and fourth side, wherein the first, second, third and fourth side surfaces together enclose a hollow interior, the hollow interior having two open ends which are located opposite to each other, and wherein the first, second, third, and fourth side surfaces, the hollow interior, and the two open ends of the hollow interior are arranged in relation to each other such that a non-closed box-like shape is formed by the first, second, third, and fourth side surfaces, the hollow interior, and the two open ends of the hollow interior, and wherein the first side surface further comprises a protruding member at an upper edge of the first side surface, the protruding member protruding substantially perpendicularly out from said first side surface in a direction such that the protruding member covers at least a portion of an upper open end of said two open ends.

6. The antenna device according to claim 5, further comprising:

fifth and sixth surfaces, wherein a lower portion of the third side surface abuts perpendicularly against the fifth surface, and the fifth surface abuts perpendicularly against the sixth surface, the sixth surface further being attached to a feeding portion connected to the radio signal feeding point.

7. The antenna device according to claim 6, the ground plane further comprising a support member attached to said ground plane at a side edge of said ground plane and further protruding substantially perpendicularly out from said ground plane, wherein the second radio signal feeding point is disposed at a center portion of said support member.

8. The antenna device according to claim 5, wherein the antenna element is operable in a frequency band being a frequency band located in the 1800 MHz, 1900 MHz, 2.0 GHz, 2.45 GHz, 3.1 GHz, 5.0 GHz, 5.8 GHz or 10.6 GHZ region.

9. The antenna device according to claim 5, wherein the antenna element is operable in a frequency band being a frequency band located within the range of 3.1-10.6 GHz.

10. A communication terminal comprising an antenna device according to claim 5.

11. The communication terminal according to claim 10, wherein the communication terminal is a device from the group comprising: a portable radio communication equipment, a mobile radio terminal, a mobile telephone, a cellular telephone, a pager, a communicator, an electronic organizer, a smart phone and a computer.

12. A radio antenna device for a radio communication terminal, the antenna device comprising:

a flat ground plane; and an antenna element having a radio signal feeding point disposed at the ground plane, wherein the antenna element is a monopole antenna element having a folded three dimensional box-like shape, wherein the antenna element comprises a plurality of side surfaces and at least one of said side surfaces is located in the same plane as said ground plane in a direction of extension of said ground plane, wherein the antenna element comprises:

first, second, third, and fourth side surfaces, respectively, wherein the first side surface abuts perpendicularly against the second side surface, the second side surface abuts perpendicularly against the third side surface, the third side surface abuts perpendicularly against the fourth side surface, and there is a gap between the first and fourth side, wherein the first, second, third and fourth side surfaces together enclose a hollow interior, the hollow interior having two open ends which are located opposite to each other, and wherein the first, second, third, and fourth side surfaces, the hollow interior, and the two open ends of the hollow interior are arranged in relation to each other such that a non-closed box-like shape is formed by the first, second, third, and fourth side surfaces, the hollow interior, and the two open ends of the hollow interior, and wherein the fourth side surface further comprises a protruding member at an outermost side edge of the fourth side surface, wherein said outermost side edge does not abut against any other side surface, and wherein the protruding member protrudes substantially perpendicularly out from an upper edge of said fourth side surface.

13. The antenna device according to claim 12, further comprising:

fifth and sixth surfaces, wherein a lower portion of the third side surface abuts perpendicularly against the fifth surface, and the fifth surface abuts perpendicularly against the sixth surface, the sixth surface further being attached to a feeding portion connected to the radio signal feeding point.

14. The antenna device according to claim 13, the ground plane further comprising a support member attached to said ground plane at a side edge of said ground plane and further protruding substantially perpendicularly out from said ground plane, wherein the second radio signal feeding point is disposed at a center portion of said support member.

15. The antenna device according to claim 12, wherein the antenna element is operable in a frequency band being a frequency band located in the 1800 MHz, 1900 MHz, 2.0 GHz, 2.45 GHz, 3.1 GHz, 5.0 GHz, 5.8 GHz or 10.6 GHZ region.

16. The communication terminal according to claim 15, wherein the communication terminal is a device from the group comprising: a portable radio communication equipment, a mobile radio terminal, a mobile telephone, a cellular telephone, a pager, a communicator, an electronic organizer, a smart phone and a computer.

17. The antenna device according to claim 12, wherein the antenna element is operable in a frequency band being a frequency band located within the range of 3.1-10.6 GHz.

18. A communication terminal comprising an antenna device according to claim 12.

* * * * *